US010316386B2

(12) United States Patent
Wang et al.

(10) Patent No.: US 10,316,386 B2
(45) Date of Patent: Jun. 11, 2019

(54) HIGH-CARBON STEEL WIRE ROD AND PREPARATION METHOD THEREFOR

(71) Applicant: INSTITUTE OF RESEARCH OF IRON AND STEEL, JIANGSU PROVINCE/SHA-STEEL, CO. LTD, Zhangjiagang Suzhou, Jiangsu (CN)

(72) Inventors: Lei Wang, Jiangsu (CN); Han Ma, Jiangsu (CN); Ping Li, Jiangsu (CN)

(73) Assignee: INSTITUTE OF RESEARCH OF IRON AND STEEL, JIANGSU PROVINCE/SHA-STEEL, CO. LTD., Zhangjiangang, Suzhou, Jiangsu (CN)

( * ) Notice: Subject to any disclaimer, the term of this patent is extended or adjusted under 35 U.S.C. 154(b) by 211 days.

(21) Appl. No.: 15/117,072

(22) PCT Filed: Feb. 18, 2014

(86) PCT No.: PCT/CN2014/072186

§ 371 (c)(1),
(2) Date: Aug. 5, 2016

(87) PCT Pub. No.: WO2015/120634

PCT Pub. Date: Aug. 20, 2015

(65) Prior Publication Data

US 2017/0175221 A1 Jun. 22, 2017

(30) Foreign Application Priority Data

Feb. 11, 2014 (CN) ..... 2014 1 0047755

(51) Int. Cl.

| | |
|---|---|
| ***B21C 1/02*** | (2006.01) |
| ***C21D 8/06*** | (2006.01) |
| ***C21D 9/52*** | (2006.01) |
| ***B22D 11/00*** | (2006.01) |
| ***C22C 33/04*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |

(52) U.S. Cl.

CPC ..... *C21D 9/525* (2013.01); *B21C 1/02* (2013.01); *B22D 11/001* (2013.01); *C22C 33/04* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C21D 8/065* (2013.01)

(58) Field of Classification Search

CPC ..... B21C 1/02; B21D 11/001; C21D 9/325; C21D 8/065; C22C 33/04; C22C 38/02; C22C 38/04; C22C 38/18; C22C 38/24; C22C 38/28

See application file for complete search history.

(56) References Cited

U.S. PATENT DOCUMENTS

| | | | |
|---|---|---|---|
| 6,277,220 | B1 | 8/2001 | Hamada et al. |
| 2002/0084003 | A1 | 7/2002 | Nagao et al. |
| 2003/0024610 | A1 | 2/2003 | Ibakaki et al. |

FOREIGN PATENT DOCUMENTS

| | | | |
|---|---|---|---|
| CN | 1354271 | A | 6/2002 |
| CN | 101321884 | A | 12/2008 |
| CN | 101353764 | A | 1/2009 |
| CN | 101429621 | A | 5/2009 |
| CN | 101649416 | A | 2/2010 |
| CN | 102634730 | A | 8/2012 |
| CN | 103122437 | A | 5/2013 |
| EP | 1865079 | A1 | 12/2007 |
| EP | 2003223 | A1 | 12/2008 |
| JP | S60181255 | A | 9/1985 |
| JP | 2001-271138 | * | 10/2001 |
| JP | 2004011002 | A | 1/2004 |
| KR | 20010023138 | A | 3/2001 |
| KR | 20080017464 | A | 2/2008 |

OTHER PUBLICATIONS

International Search Report dated Aug. 6, 2014 for PCT/CN2014/072186.

Extended European Search Report dated Sep. 4, 2017 for corresponding European Application No. 14882598.7.

Chinese first Office Action dated Jun. 5, 2015 for corresponding Chinese Patent Application No. 201410047755.7.

* cited by examiner

*Primary Examiner* — C Melissa Koslow

(74) *Attorney, Agent, or Firm* — Lucas & Mercanti, LLP

(57) ABSTRACT

There is provided a high-carbon steel wire rod and a preparation method thereof. Wherein, the high-carbon steel wire rod comprising the following ingredients: C, Si, Mn, Cr, V, Ti and Fe. The high-carbon steel wire rod has satisfactory mechanical properties, including high strength with an average tensile strength of 1560 MPa as well as good plasticity with an average after-fracture shrinkage rate of 30% and an after-fracture elongation percentage larger than or equal to 9%, which can meet the performance requirements for producing 2300 MPa level pre-stressed steel strand.

6 Claims, No Drawings

HIGH-CARBON STEEL WIRE ROD AND PREPARATION METHOD THEREFOR

CROSS REFERENCE TO RELATED APPLICATION

This Application is a 371 of PCT/CN2014/072186 filed on Feb. 18, 2014, which claims priority of Chinese Application No. 201410047755.7 filed Feb. 11, 2014, both of which are incorporated herein by reference.

TECHNICAL FIELD

The present invention relates to the field of alloy, and in particular relates to a high-carbon steel wire rod and a preparation method thereof.

BACKGROUND OF THE INVENTION

High-carbon steel wire rods can be used for producing products such as high-strength pre-stressed steel wire, steel strand, spring steel wire, steel rope and steel cord. The production of these products requires the high-carbon steel wire rod to be stretched for multiple times, with a stretching area reduction rate that maximally reaches 96%. Such a high stretching area reduction rate necessarily has high requirements for various aspects such as strength, plasticity, surface quality and purity of the high-carbon steel material.

Currently, the pre-stressed steel wires and steel strands on the domestic market are mainly 1860 MPa level products made of the raw material of SWRH82B high-carbon steel wire rod with a diameter of 11-13 mm and a strength of 1130-1200 MPa. There are also 1960 MPa level pre-stressed steel strands or even 2100 MPa level pre-stressed steel strands. In the steel manufacturing industry, it has always been a trend for research and development in this field to develop high-strength steel material, as the increase of steel material strength would reduce the usage amount of steel material. For instance, the usage amount of steel material by a 2300 MPa level steel strand is about 24% less than by an 1860 MPa level steel strand. Meanwhile, the increase of steel material strength would also simplify the pre-stressed structure and reduce the construction cost, which has significant economic and social benefits.

Chinese Patent Literature CN103122437A discloses a vanadium-silicon composite micro-alloyed super-high-strength coil rod and a preparation method thereof. This coil rod comprises 0.85%-0.95% of C, 0.95%-1.10% of Si, 0.50%-0.60% of Mn, 0.20%-0.35% of Cr, 0.01%405% of Ti, 0.005%4050% of Al and 0.11%-0.15% of V, as well as one or more selected from the group consisting of 0.001%-0.15% of Ni, 0.001%425% of Cu, 0.0001%4005% of B, 0.01%-0.03% of Nb and 0.001%-0.03% of Mo, with the remainder being Fe and impurities. The aforementioned coil rod has high strength with a tensile strength larger than 1370 MPa and can be used for producing 2140 MPa level pre-stressed steel strand. However, the aforementioned coil rod cannot meet the requirement of higher strength pre-stress, and it remains a research hotspot in the field of alloy to achieve preparation of higher strength pre-stressed steel strand.

SUMMARY OF THE INVENTION

Thus, a technical problem to be solved by the present invention is to provide a high-carbon steel wire rod that has a tensile strength larger than 1530 MPa and meets the preparation requirements of 2300 MPa level pre-stressed steel strand The present invention also provides a preparation method of the above-mentioned high-carbon steel wire rod.

The high-carbon steel wire rod of the present invention comprises the following ingredients calculated in weight percentage:

0.88%-494% of C,
1.25%-1.50% of Si,
0.45%-0.55% of Mn,
0.25%-0.45% of Cr,
0.16%-0.20% of V,
0.02%-408% of Ti, and
the remainder being Fe.

The high-carbon steel wire rod also comprises one or more selected from the group consisting of:

0.01%-0.15% of Mo,
0.001%-0.100% of Al,
0.0005%-0.0015% of B, and
0.01%-0.03% of Nb.

Preferably, the high-carbon steel wire rod comprises the following ingredients calculated in weight percentage:

0.92% of C,
1.35% of Si,
0.50% of Mn,
0.26% of Cr,
0.18% of V,
0.07% of Ti, and
the remainder being Fe.

It needs to be explained that, the high-carbon steel wire rod of the present invention might contain micro-quantity of unavoidable impurities during the preparation process, which does not affect the implementation of the present invention and the realization of its technical effects.

The preparation method of the high-carbon steel wire rod comprises the following steps:

1) smelting: melting metal feedstock and smelting the metal feedstock to reach a C content of 0.2%-0.7% and a P content of less than 110 ppm, and then performing steel tapping at 1590-1610° C., wherein, molten iron accounts for 70%-85% of the total weight of the metal feedstock after melting;

2) refining: adding alloy materials that contain one or more selected from the group consisting of Cr, Si, Mn, Al, Ti, V, B, Mo and Nb while refining for longer than or equal to 40 min;

3) continuous casting: controlling superheat degree to be less than or equal to 30° C., and keeping a constant drawing speed of 2.50-2.60 m/min to form a continuous casting billet;

4) rolling: heating at an air-to-coal ratio of less than or equal to 0.7, and rolling the continuous casting billet obtained in the step 3) at a rolling temperature of 900-1100° C., with a spinning temperature of 830-860° C.;

5) cooling: by means of controlled Stelmor cooling, keeping a cooling rate of 8-11 K/s before austenite phase transformation and keeping a cooling rate of 1-2 K/s after austenite phase transformation, with a final cooling temperature of above 500° C.

Wherein, the superheat degree refers to the difference value between the continuous casting temperature and the melting point of the molten steel. The air-to-coal ratio refers to the volume ratio between the air used by the heating furnace and the blast furnace gas.

In the step 1), the metal feedstock is a mixture of steel scrap and molten iron.

Before the smelting of the step 1), preliminary desulfurization is performed on the molten iron to control its sulfur content to stay below 0.005%.

The step 2) comprises adding alloy materials that contain Cr, Si, Mn, Al, Mo, Nb, Ti, V in sequence, refining with a refining slag alkalinity kept at 2.8-3.0, and adding an alloy material that contains B at 15 min before finish of refining, under soft stirring by blowing inert gas for longer than or equal to 15 min.

The continuous casting in the step 3) includes first-cooling and second-cooling, the first-cooling is water cooling with a specific water flow of 4.1-4.5 L/kg, and the second-cooling is mist cooling with a specific water flow of 1.8-2.0 L/kg.

The rolling in the step 4) includes rough rolling and precision rolling, the rough rolling is performed on the continuous casting billet obtained in the step 3) at 1000-1100° C., and then the precision rolling is performed at 900-950° C.

In the step 5), before the phase transformation, the moving speed of the wire rod is 0.8-1.3 m/s and the wind velocity of the blower is 30-40 m/s; after the phase transformation, the moving speed of the wire rod is 0.6-0.8 m/s and the wind velocity of the blower is 0-10 m/s.

The present invention also provides use of the high-carbon steel wire rod for producing 2300 MPa level pre-stressed steel wire, 2300 MPa level pre-stressed steel strand, or 1960 MPa level bridge cable zinc-coated steel wire.

Si is a ferrite strengthening element that is able to increase the strength of ferrite by solid solution strengthening. Furthermore, enrichment of Si at the interface between ferrite and cementite helps to improve the thermal stability of steel wire during heat treatment process. Si can increase the diffusion speed of C in austenite and facilitate the homogenization process of C during the heating process. Meanwhile, Si increases the activity of C and renders C easier to combine with V, so as to facilitate the precipitation of V—C from ferrite. However, too much Si causes decarburization which reduces surface quality.

Mn is able to eliminate or alleviate hot brittleness of steel caused by sulfur, so as to improve hot workability of the steel. Mn can also form solid solution with Fe, thereby increasing the hardness and strength of ferrite and austenite in the steel. Meanwhile, Mn is a carbide forming element that is able to enter cementite to substitute a part of the iron atoms. Mn in the steel can reduce the critical transformation temperature, so as to attain fine pearlite, thereby increasing the strength of pearlite steel. Furthermore, Mn has an austenite stabilization capability that is only inferior to Ni, and can significantly increase the hardenability of steel.

Cr is a strong carbide producing element which mainly exists in cementite layers of steel and forms alloy cementite by substitution. Adding of Cr increases the stability of austenite and prevents the crystal grains from growing larger during hot rolling. Besides, adding of Cr causes a continuous cooling transformation curve of the steel to shift to the right, so that the distances between pearlite layers become smaller under the same cooling speed. Because of the existence of alloy cementite in the pearlite, adding of Cr helps to increase the thermal stability of the cementite layers.

V combines with C and N in steel to form dispersed precipitation of V—N—C, so as to inhibit the growing of austenite crystal grains during hot rolling. V also tends to form V—C particles on austenite grain boundaries during the initial stage of phase transformation, so as to reduce the content of C element on the grain boundaries, thereby effectively inhibiting the production of network cementite. Meanwhile, V tends to precipitate between ferrite in pearlite during the phase transformation process, thereby having a precipitation strengthening effect on the high-carbon steel wire rod, which is helpful for increasing the strength of the high-carbon steel wire rod. However, too much V causes difficulty in material structure control of the high-carbon steel wire rod.

Ti is able to immobilize the free nitrogen in the molten steel, so as to prevent natural ageing phenomenon caused by free nitrogen dissolved in steel and thus prevent the increase of brittleness of the steel, thereby increasing the plasticity and tenacity of the steel.

Mo is able to notably increase the hardenability of high-carbon steel. Meanwhile, Mo is able to reduce the possibility of network cementite existing on the grain boundaries, which is helpful for increasing the plasticity of the high-carbon steel wire rod. However, excessive Mo tends to act together with Cr to cause separation of the pearlite transformation curve and the bainite transformation curve, and thus results in that bainite structure is easy to beproduced in the high-carbon steel during the continuous cooling process.

Al is an active metal which easily reacts with oxygen in molten steel to produce $Al_2O_3$, it can be used as an important deep deoxidation agent in steel, so as to reduce the oxygen content in the molten steel and thus reduce the inclusions in the molten steel, thereby increasing the purity of the molten steel. Besides, Al is able to combine with N in molten steel to produce Al—N, so that fine Al—N particles precipitate in the molten steel, which inhibits the growing of austenite crystal grains during the heating process before hot rolling, thereby reducing the crystal granularity of austenite.

B tends to have segregation on crystal grain boundaries, which inhibits the nucleation of proeutectoid ferrite on the austenite grain boundaries. However, B easily combines with free nitrogen in steel to form brittle excluded phase, which results in brittleness of the wire rod.

Nb is able to combine with C and N in steel to form Nb(N,C), which inhibits the growing of austenite crystal grains. By preventing recrystallization or dynamic recrystallization, Nb in solid solution is able to prevent the crystal grains from growing larger.

Compared to prior art, the aforementioned technical solution of the present invention has the following advantages:

(1) The high-carbon steel wire rod of the present invention comprises C, Si, Mn, Cr, V, Ti, Fe and impurities. Wherein, the V content is 0.16%-0.20%, and in this range, the attained high-carbon steel wire rod has a full-pearlite structure with a sorbite content over 95% and the distances between pearlite layers being 80-100 μm, and therefore has a relatively uniform structure. Adding V inhibits the production of network cementite, thereby significantly increasing the mechanical strength. Meanwhile, the Si content is kept at 1.25%-1.50%. It is found after repeated experiments that, when the Si content is over 1.2%, the precipitation promotion effect towards V is most significant. When Si is in the range of 1.25%-1.50%, the thickness of decarburization layer is controllable, and the activity of C atoms in austenite can be increased, so as to render C easier to combine with V and thus significantly facilitate the precipitation of V, thereby considerably increasing the strength of the high-carbon steel wire rod.

In the high-carbon steel wire rod, by combination of Mn, Cr, Ti that has been added in and content control thereof, the high-carbon steel wire rod is rendered to have satisfactory mechanical properties, including high strength with an average tensile strength of 1560 MPa as well as good plasticity with an average after-fracture shrinkage rate of 30% and an after-fracture elongation percentage larger than or equal to 9%, which can meet the performance requirements for producing 2300 MPa level pre-stressed steel strand. Wherein, the 0.02%-0.08% of Ti that has been added in can combine with free N to form dispersed fine TiN so as to immobilize the free nitrogen in steel. Because the electric arc in the electric furnace smelting process ionizes the air and results in a high nitrogen content in molten steel, and free nitrogen dissolved in steel causes natural ageing phenomenon which increases the brittleness of steel, therefore, by controlling the free nitrogen content in steel to stay below 50 ppm, by adding 0.02%408% of Ti for immobilizing the free nitrogen to form TiN, and by controlling the precipitation and growing of TiN by means of controlling the cooling speed of casting billet and controlling the heating temperature before hot rolling, the strength of the attained high-carbon steel wire rod is increased.

(2) The high-carbon steel wire rod of the present invention further comprises one or more selected from the group consisting of Mo, Al, B, Nb. Wherein, Mo is able to notably increase the hardenability of high-carbon steel and reduce the distances between pearlite layers, and meanwhile Mo is also able to reduce the possibility of network cementite existing on the grain boundaries, which is helpful for increasing the plasticity of the high-carbon steel wire rod. Al has a deep deoxidation function, which is helpful for increasing the purity of the molten steel. B has a function of reducing the existence of ferrite on crystal grain boundaries of the high-carbon steel. Nb produces dispersed precipitated fine carbides and solid solution of Nb, so as to attain fine austenite crystal grains, thereby increasing the strength and plasticity of the wire rod.

(3) The high-carbon steel wire rod of the present invention comprises 0.92% of C, 1.35% of Si, 0.50% of Mn, 0.26% of Cr, 0.18% of V, 0.07% of Ti, and the remainder being Fe. With such compounding ratio, the attained high-carbon steel wire rod has a tensile strength up to 1575 MPa, an after-fracture shrinkage rate up to 36% and an after-fracture elongation percentage up to 10%, and therefore has superior mechanical performances.

(4) The preparation method of the high-carbon steel wire rod of the present invention comprises pre-treatment of molten steel, electric furnace smelting, refining, continuous casting, and rolling. During manufacture, the rolling temperature and cooling temperature are controlled to prevent carburization or abnormal microstructure from being formed and meanwhile allow the sorbitizing rate to reach a level of more than 95%.

(5) In the preparation method of the high-carbon steel wire rod of the present invention, because, along with the increase of the requirements towards tensile strength, the defect sensitivity of the product also increases, the continuous casting in the method of the present invention is divided into first-cooling and second-cooling, wherein the second-cooling utilizes mist cooling, and as a result, the attained continuous casting billet has compact microstructure and a small degree of micro-segregation, so that the microstructure uniformity of the rolled product is ensured.

(6) In the preparation method of the high-carbon steel wire rod of the present invention, the molten iron is first desulfurized to reduce the sulfur content in the molten iron to a level below 0.005%, so as to increase the purity of the molten iron, which alleviates the desulfurization load during the refining process and better reduces the impurity content in the produced high-carbon steel wire rod, thereby ensuring the performance of the wire rod.

DETAILED DESCRIPTION OF EMBODIMENTS

TABLE 1

Contents of respective ingredients of the high-carbon steel wire rods in Embodiments 1-11 and Comparison Examples 1-4

| | C | Si | Mn | Cr | V | Ti | Mo | Al | B | Nb |
|---|---|---|---|---|---|---|---|---|---|---|
| Embodiment 1 | 0.88 | 1.50 | 0.50 | 0.35 | 0.16 | 0.08 | — | — | — | — |
| Embodiment 2 | 0.94 | 1.38 | 0.45 | 0.45 | 0.20 | 0.02 | 0.01 | — | — | — |
| Embodiment 3 | 0.91 | 1.25 | 0.55 | 0.25 | 0.18 | 0.05 | — | 0.10 | — | — |
| Embodiment 4 | 0.90 | 1.40 | 0.46 | 0.40 | 0.19 | 0.06 | — | — | 0.0010 | — |
| Embodiment 5 | 0.94 | 1.38 | 0.45 | 0.45 | 0.20 | 0.02 | — | — | — | 0.03 |
| Embodiment 6 | 0.91 | 1.25 | 0.55 | 0.25 | 0.18 | 0.05 | 0.15 | — | 0.0015 | — |
| Embodiment 7 | 0.90 | 1.40 | 0.46 | 0.40 | 0.19 | 0.06 | 0.08 | 0.001 | — | — |
| Embodiment 8 | 0.89 | 1.50 | 0.50 | 0.30 | 0.20 | 0.07 | — | 0.05 | — | 0.01 |
| Embodiment 9 | 0.88 | 1.50 | 0.50 | 0.35 | 0.16 | 0.08 | — | — | 0.0005 | 0.02 |
| Embodiment 10 | 0.94 | 1.38 | 0.45 | 0.45 | 0.20 | 0.02 | 0.012 | 0.005 | 0.0010 | 0.02 |
| Embodiment 11 | 0.92 | 1.35 | 0.50 | 0.26 | 0.18 | 0.07 | — | 0.015 | 0.0015 | — |
| Comparison Example 1 | 0.88 | 1.50 | 0.50 | 0.35 | — | 0.08 | — | — | — | — |
| Comparison Example 2 | 0.88 | 0.25 | 0.50 | 0.35 | 0.16 | 0.08 | — | — | — | — |
| Comparison Example 3 | 0.88 | 1.00 | 0.50 | 0.35 | 0.16 | 0.08 | — | — | — | — |
| Comparison Example 4 | 0.88 | 1.60 | 0.50 | 0.35 | 0.16 | 0.08 | — | — | — | — |

Embodiment 1

The high-carbon steel wire rod of this embodiment has a composition of ingredients as listed in Table 1, and its preparation method comprises the following steps:

1) Pre-desulfurization of molten iron: by using a KR desulfurization method, adding CaO as a desulfurization agent to remove sulfur from the molten iron, until the sulfur content is below 0.005%.

2) Electric furnace smelting: feeding metal feedstock into an electric furnace, using low voltage and current to start the arc at the beginning of the smelting process, and when the current stabilizes after about 1 min, gradually increasing the voltage and current to perform puncturing. Using stream slag smelting in the smelting process, and intensifying the slag exchanging to produce foam slag and prevent nitrogen increase. Controlling the end point at a C content of 0.2% and a P content below 110 ppm, and then performing steel tapping while controlling the tapping temperature at 1590° C. and controlling the argon stirring pressure at 1 MPa. When ⅓ of the steel tapping is reached, adding special synthetic slag for high-carbon steel and 70% of the total amount of the alloy material containing Cr, Si, Mn into the steel. Slag outflow should be prevented during the steel tapping, and if there is slag outflow phenomenon, a de-slagging operation should be performed.

Wherein, the metal feedstock includes 18 tons of steel scrap and 82 tons of molten iron.

3) Refining: adding the remaining alloy material containing Cr, Si, alloy material containing Al, alloy material containing Mo, alloy material containing Nb, alloy material containing Ti and alloy material containing V in sequence, performing LF refining, controlling the refining slag binary alkalinity at 2.8 and (FeO)+(MnO)≤1.0%, until the contents of respective ingredients in the molten steel reaches the predetermined values in Table 1. At 15 min before finish of refining, feeding SiCa wire and B wire, soft stirring by blowing argon gas for 15 min, and then adding a thermal insulating agent.

The thermal insulating agent is carbonized rice husk.

4) Continuous casting: controlling the superheat degree at 30° C., keeping a constant drawing speed of 2.50 m/min, the first-cooling utilizes water cooling with a specific water flow of 4.2 L/kg, and the second-cooling utilizes mist cooling with a specific water flow of 1.9 L/kg, so as to produce a billet with a square cross-section of 140 mm×140 mm×16 m as the continuous casting billet.

5) Rolling: heating while keeping the air-to-coal ratio below 0.7, performing rough rolling on the continuous casting billet obtained in the step 4) at 1000° C., and then performing precision rolling at 950° C., with a spinning temperature of 830° C.

6) Cooling: by means of controlled Stelmor cooling, keeping a cooling rate of 9 K/s before austenite phase transformation with the moving speed of the wire rod being 0.8 m/s and the wind velocity of the blower being 30 m/s; keeping a cooling rate of 1 K/s after austenite phase transformation with the moving speed of the wire rod being 0.8 m/s and the wind velocity of the blower being 10 m/s, so as to reduce the steel temperature to 510° C.

Embodiment 2

The high-carbon steel wire rod of this embodiment has a composition of ingredients as listed in Table 1, and its preparation method comprises the following steps:

1) Pre-desulfurization of molten iron: by using a KR desulfurization method, adding CaO as a desulfurization agent to remove sulfur from the molten iron, until the sulfur content is below 0.005%.

2) Electric furnace smelting: feeding metal feedstock into an electric furnace, using low voltage and current to start the arc at the beginning of the smelting process, and when the current stabilizes after about 1 min, gradually increasing the voltage and current to perform puncturing. Using stream slag smelting in the smelting process, and intensifying the slag exchanging to produce foam slag and prevent nitrogen increase. Controlling the end point at a C content of 0.7% and a P content below 110 ppm, and then performing steel tapping while controlling the tapping temperature at 1610° C. and controlling the argon stirring pressure at 0.1 MPa. When ⅓ of the steel tapping is reached, adding special synthetic slag for high-carbon steel and 70% of the total amount of the alloy material containing Cr, Si, Mn into the steel. Slag outflow should be prevented during the steel tapping, and if there is slag outflow phenomenon, a de-slagging operation should be performed.

Wherein, the metal feedstock includes 30 tons of steel scrap and 70 tons of molten iron.

3) Refining: adding the remaining alloy material containing Cr, Si, alloy material containing Al, alloy material containing Mo, alloy material containing Nb, alloy material containing Ti and alloy material containing V in sequence, performing LF refining, controlling the refining slag binary alkalinity at 3.0 and (FeO)+(MnO)≤1.0%, until the contents of respective ingredients in the molten steel reaches the predetermined values in Table 1. At 15 min before finish of refining, feeding SiCa wire and B wire, soft stirring by blowing argon gas for 15 min, and then adding a thermal insulating agent.

The thermal insulating agent is carbonized rice husk.

4) Continuous casting: controlling the superheat degree at 27° C., keeping a constant drawing speed of 2.60 m/min, the first-cooling utilizes water cooling with a specific water flow of 4.5 L/kg, and the second-cooling utilizes mist cooling with a specific water flow of 1.8 L/kg, so as to produce a billet with a square cross-section of 140 mm×140 mm×16 m as the continuous casting billet.

5) Rolling: heating while keeping the air-to-coal ratio below 0.7, performing rough rolling on the continuous casting billet obtained in the step 4) at 1100° C., and then performing precision rolling at 900° C., with a spinning temperature of 860° C.

6) Cooling: by means of controlled Stelmor cooling, keeping a cooling rate of 11 K/s before austenite phase transformation with the moving speed of the wire rod being 0.8 m/s and the wind velocity of the blower being 30 m/s; keeping a cooling rate of 2 K/s after austenite phase transformation with the moving speed of the wire rod being 0.7 m/s and the wind velocity of the blower being 10 m/s, so as to reduce the steel temperature to 550° C.

Embodiment 3

The high-carbon steel wire rod of this embodiment has a composition of ingredients as listed in Table 1, and its preparation method comprises the following steps:

1) Pre-desulfurization of molten iron: by using a KR desulfurization method, adding CaO as a desulfurization agent to remove sulfur from the molten iron, until the sulfur content is below 0.005%.

2) Electric furnace smelting: feeding metal feedstock into an electric furnace, using low voltage and current to start the arc at the beginning of the smelting process, and when the current stabilizes after about 1 min, gradually increasing the voltage and current to perform puncturing. Using stream slag smelting in the smelting process, and intensifying the slag exchanging to produce foam slag and prevent nitrogen increase. Controlling the end point at a C content of 0.5% and a P content below 110 ppm, and then performing steel tapping while controlling the tapping temperature at 1600° C. and controlling the argon stirring pressure at 0.6 MPa. When 1/3 of the steel tapping is reached, adding special synthetic slag for high-carbon steel and 70% of the total amount of the alloy material containing Cr, Si, Mn into the steel. Slag outflow should be prevented during the steel tapping, and if there is slag outflow phenomenon, a de-slagging operation should be performed.

Wherein, the metal feedstock includes 15 tons of steel scrap and 85 tons of molten iron.

3) Refining: adding the remaining alloy material containing Cr, Si, alloy material containing Al, alloy material containing Mo, alloy material containing Nb, alloy material containing Ti and alloy material containing V in sequence, performing LF refining, controlling the refining slag binary alkalinity at 2.9 and (FeO)+(MnO)≤1.0%, until the contents of respective ingredients in the molten steel reaches the predetermined values in Table 1. At 15 min before finish of refining, feeding SiCa wire and B wire, soft stirring by blowing argon gas for 15 min, and then adding a thermal insulating agent.

The thermal insulating agent is carbonized rice husk.

4) Continuous casting: controlling the superheat degree at 27° C., keeping a constant drawing speed of 2.60 m/min, the first-cooling utilizes water cooling with a specific water flow of 4.1 L/kg, and the second-cooling utilizes mist cooling with a specific water flow of 2.0 L/kg, so as to produce a billet with a square cross-section of 140 mm×140 mm×16 m as the continuous casting billet.

5) Rolling: heating while keeping the air-to-coal ratio below 0.7, performing rough rolling on the continuous casting billet obtained in the step 4) at 1050° C., and then performing precision rolling at 930° C., with a spinning temperature of 840° C.

6) Cooling: by means of controlled Stelmor cooling, keeping a cooling rate of 8 K/s before austenite phase transformation with the moving speed of the wire rod being 1.3 m/s and the wind velocity of the blower being 40 m/s; keeping a cooling rate of 2 K/s after austenite phase transformation with the moving speed of the wire rod being 0.6 m/s and the wind velocity of the blower being 5 m/s, so as to reduce the steel temperature to 550° C.

Embodiment 4

The high-carbon steel wire rod of this embodiment has a composition of ingredients as listed in Table 1, and its preparation method comprises the following steps:

1) Pre-desulfurization of molten iron: by using a KR desulfurization method, adding CaO as a desulfurization agent to remove sulfur from the molten iron, until the sulfur content is below 0.005%.

2) Electric furnace smelting: melting metal feedstock and smelting the metal feedstock to reach a C content of 0.2% and a P content below 110 ppm, and then performing steel tapping at 1600° C.

3) Refining: adding alloy materials that contain Cr, Si, Mn, Al, Ti, V and B while refining for 40 min and controlling the refining slag alkalinity at 2.8-3.0.

4) Continuous casting: controlling the superheat degree at 30° C. and keeping a constant drawing speed of 2.50 m/min to produce a continuous casting billet.

5) Rolling: heating with the air-to-coal ratio kept at 0.5, and rolling the continuous casting billet obtained in the step 4) at a rolling temperature of 900° C., with a spinning temperature of 860° C.

6) Cooling: by means of controlled Stelmor cooling, keeping a cooling rate of 11 K/s before austenite phase transformation and keeping a cooling rate of 2 K/s after austenite phase transformation, with a final cooling temperature of 540° C.

Embodiment s 5-11

The high-carbon steel wire rods of Embodiments 5-11 have compositions of ingredients as listed in Table 1, and their preparation methods are similar to that of Embodiment 1.

Embodiment 12

The pre-stressed steel strand of this embodiment is produced by the following method:

1) Pickling and phosphating the high-carbon steel wire rod of Embodiment 1.

2) Cold-drawing the high-carbon steel wire rod through 8 molds in sequence so as to produce a steel wire.

The cold-drawing sequence is sequentially Φ13.0 mm→Φ11.4 mm→Φ10.0 mm→Φ7.98 mm→Φ7.27 mm→Φ6.55 mm→Φ5.48 mm→Φ5.36 mm→Φ5.02 mm.

3) Joining the strings of the steel wires attained by the above-mentioned cold-drawing, and performing stabilization treatment at a temperature of 380±10° C., so as to produce a pre-stressed steel strand.

Embodiment 13

The pre-stressed steel wire of this embodiment is produced by the following method:

1) Pickling and phosphating the high-carbon steel wire rod of Embodiment 2.

2) Cold-drawing the high-carbon steel wire rod through 8 molds in sequence so as to produce a steel wire.

The cold-drawing sequence is sequentially Φ13.0 mm→Φ11.4 mm→Φ10.0 mm→Φ7.98 mm→Φ7.27 mm→Φ6.55 mm→Φ5.48 mm→Φ5.36 mm→Φ5.02 mm.

3) Performing stabilization treatment on the steel wire attained by the above-mentioned cold-drawing at a temperature of 380±10° C., so as to produce a pre-stressed steel wire.

Embodiment 14

The bridge cable zinc-coated steel wire of this embodiment is produced by the following method:

1) Pickling and phosphating the high-carbon steel wire rod of Embodiment 2.

2) Cold-drawing the high-carbon steel wire rod through 9 molds in sequence so as to produce a steel wire.

The cold-drawing sequence is sequentially Φ13.0 mm→Φ11.5 mm→Φ10.2 mm→9.28 mm→Φ8.73 mm→Φ8.45 mm→Φ8.15 mm→Φ7.9 mm→Φ7.4 mm→Φ6.9 mm.

3) performing alkali wash, acid wash, water wash, drying, pre-coating on the steel wire attained by the above-mentioned cold-drawing, and then performing hot zinc-coating treatment at 450° C. After that, performing stabilization treatment on the zinc-coated steel wire at 380° C., so as to produce a bridge cable zinc-coated steel wire.

Embodiment 15

The pre-stressed steel strand of this embodiment is made from the high-carbon steel wire rod produced in Embodiment 11, and its preparation method is similar to that of Embodiment 12.

Comparison Examples 1-4

The high-carbon steel wire rods of Comparison Examples 1-4 have compositions of ingredients as listed in Table 1, and their preparation methods are similar to that of Embodiment 1.

Comparison Examples 5-8

The pre-stressed steel strands of Comparison Examples 5-8 are respectively made from the high-carbon steel wire rods produced in Comparison Examples 1-4, and their preparation methods are similar to that of Embodiment 12.

Effect Experiment Examples

In order to prove the technical effects of the present invention, the following experiments are performed on the products prepared in Embodiments 1-15 and Comparison Examples 1-8:

1. Experiments on the high-carbon steel wire rods produced in Embodiments 1-11 and Comparison Examples 1-4:

(1) Experimental methods:

1.1 Tests of mechanical properties: according to the national standard GB/T228.1-2010, the tensile strength, after-fracture shrinkage rate and after-fracture elongation percentage of the high-carbon steel wire rods are tested.

1.2 Tests of sorbitizing rate: tests are carried out by using the image analyzer method in YB/T169-2000.

(2) Experimental results:

TABLE 2

Test results of the respective indicators of the high-carbon steel wire rods of Embodiments 1-11 and Comparison Examples 1-4

| | tensile strength (MPa) | after-fracture shrinkage rate (%) | after-fracture elongation percentage (%) | sorbitizing rate (%) |
|---|---|---|---|---|
| Embodiment 1 | 1565 | 32% | 10% | 96% |
| Embodiment 2 | 1550 | 35% | 9% | 95% |
| Embodiment 3 | 1570 | 33% | 9% | 96% |
| Embodiment 4 | 1545 | 33% | 9% | 96% |
| Embodiment 5 | 1570 | 32% | 9% | 97% |
| Embodiment 6 | 1585 | 25% | 9% | 96% |
| Embodiment 7 | 1595 | 28% | 9% | 96% |
| Embodiment 8 | 1575 | 33% | 9% | 94% |
| Embodiment 9 | 1570 | 30% | 8% | 95% |
| Embodiment 10 | 1555 | 33% | 9% | 97% |
| Embodiment 11 | 1575 | 36% | 10% | 97% |
| Comparison Example 1 | 1230 | 35% | 10% | 90% |
| Comparison Example 2 | 1420 | 35% | 9% | 95% |
| Comparison Example 3 | 1500 | 28% | 7% | 95% |
| Comparison Example 4 | 1540 | 23% | 7% | 95% |

In Comparison Example 1, V is not added; in Comparison Example 2, Si is not added; in Comparison Example 3, the added amount of Si is lower than 1.25%; and in Comparison Example 4, the added amount of Si is higher than 1.50%. When the high-carbon steel wire rods of Embodiments 1-11 are compared with those of Comparison Examples 1-4, they have superior mechanical properties, including high mechanical strength with an average tensile strength of 1568 MPa as well as good plasticity with an average after-fracture shrinkage rate of 33% and an average after-fracture elongation percentage of 9%. Especially, the product of Embodiment 11 has a tensile strength of 1575 MPa, an after-fracture shrinkage rate of 36% and an after-fracture elongation percentage of 10%, and thus has the most satisfactory mechanical performance. In comparison, as for Comparison Examples 1-4, the products of Comparison Examples 1 and 2 has relatively lower tensile strength, the product of Comparison Example 3 has a tensile strength that only reaches 1500 MPa, the high-carbon steel wire rod of Comparison Example 4 has severe decarburization and its cross-section shrinkage rate cannot meet the requirements for use. Thus it can be seen that, it is not true that higher Si content is more capable of promoting the V precipitation and increasing mechanical property. Instead, when the Si content is in the range of 1.25%-1.50%, its promoting effect on the V precipitation is most satisfactory.

2. Experiments on the pre-stressed steel strand, pre-stressed steel wire and bridge cable zinc-coated steel wire produced in Embodiments 12-15 and Comparison Examples 5-8:

(1) Experimental methods:

According to the method in the national standard GB/T228.1-2010, the tensile strength and the total elongation percentage at maximum force of the steel wires and steel strands are tested.

(2) Experimental results:

TABLE 3

Test results of the respective indicators of Embodiments 12-15 and Comparison Examples 5-8

| | tensile strength (MPa) | total elongation percentage at maximum force (%) |
|---|---|---|
| Embodiment 12 | 2382 | 4.2 |
| Embodiment 13 | 2405 | 4.5 |
| Embodiment 14 | 2015 | 5.4 |
| Embodiment 15 | 2420 | 4.8 |
| Comparison Example 5 | 2011 | 4.5 |
| Comparison Example 6 | 2200 | 4.2 |
| Comparison Example 7 | 2270 | 3.5 |
| Comparison Example 8 | 2320 | 3.1 |

When the pre-stressed steel strands of Embodiments 12, 13, 15 are compared with those of Comparison Examples 5-8, their strength meets the strength requirements of 2300 MPa level pre-stressed steel strand, and their total elongation percentage at maximum force meets the standard of larger than 3.5%. The strength of the products of Comparison Examples 5-7 does not reach 2300 MPa, and the total elongation percentage at maximum force of the product of Comparison Example 8 does not meet the requirement. In addition, the strength of the bridge cable zinc-coated steel wire in Embodiment 14 reaches 2015 MPa and its total elongation percentage at maximum force reaches 5.4%, which meets the mechanical performance requirements for 7 mm bridge cable zinc-coated steel wire.

Apparently, the aforementioned embodiments are merely examples illustrated for clearly describing the present invention, rather than limiting the implementation ways thereof. For those skilled in the art, various changes and modifications in other different forms can be made on the basis of the aforementioned description. It is unnecessary and impossible to exhaustively list all the implementation ways herein. However, any obvious changes or modifications derived from the aforementioned description are intended to be embraced within the protection scope of the present invention.

The invention claimed is:

1. A preparation method of a high-carbon steel wire rod comprising the following ingredients calculated in weight percentage:

0.88%-0.94% of C,
1.25%-1.50% of Si,
0.45%-0.55% of Mn,
0.25%-0.45% of Cr,
0.16%-0.20% of V,
0.02%-0.08% of Ti,
0.01%-0.15% of Mo,
0.001%-0.100% of Al,
0.0005%-0.0015% of B, and
0.01%-0.03% of Nb and
the remainder being Fe, the method comprising the following steps:

1) smelting: melting metal feedstock and smelting the metal feedstock to reach a C content of 0.2%-0.7% and a P content of less than 110 ppm, and then performing steel tapping at 1590-1610° C., wherein, molten iron accounts for 70%-85% of the total weight of the metal feedstock after melting;
2) refining: adding alloy materials that contain Cr, Si, Mn, Al, Ti, V, B, Mo and Nb while refining for longer than or equal to 40 min;

3) continuous casting: controlling superheat degree to be less than or equal to 30° C., and keeping a constant drawing speed of 2.50-2.60 m/min to form a continuous casting billet;

4) rolling: heating at an air-to-coal ratio of less than or equal to 0.7, and rolling the continuous casting billet obtained in the step 3) at a rolling temperature of 900-1100° C., with a spinning temperature of 830-860° C.;

5) cooling: by means of controlled Stelmor cooling, keeping a cooling rate of 8-11 K/s before austenite phase transformation and keeping a cooling rate of 1-2 K/s after austenite phase transformation, with a final cooling temperature of above 500° C.

2. The preparation method of claim 1, wherein, in the step 1), the metal feedstock is a mixture of steel scrap and molten iron.

3. The preparation method of claim 1, wherein, before the smelting of step 1), preliminary desulfurization of the molten iron to control its sulfur content to stay below 0.005% is performed.

4. The preparation method of claim 1, wherein, step 2) comprises adding alloy materials that contain Cr, Si, Mn, Al, Mo, Nb, Ti, V in sequence, refining with a refining slag alkalinity kept at 2.8-3.0, and adding an alloy material that contains B at 15 min before finish of refining, under soft stirring by blowing inert gas for longer than or equal to 15 min.

5. The preparation method of claim 1, wherein, the continuous casting in step 3) includes first-cooling and second-cooling, the first-cooling is water cooling with a specific water flow of 4.1-4.5 L/kg, and the second-cooling is mist cooling with a specific water flow of 1.8-2.0 L/kg.

6. The preparation method of claim 1, wherein, the rolling in step 4) includes rough rolling and precision rolling, the rough rolling is performed on the continuous casting billet obtained in the step 3) at 1000-1100° C., and then the precision rolling is performed at 900-950° C.

* * * * *